US006372417B1

(12) United States Patent
Gray et al.

(10) Patent No.: US 6,372,417 B1
(45) **Date of Patent: *Apr. 16, 2002**

(54) METHOD OF PROCESSING A PHOTOGRAPHIC HIGH CONTRAST SILVER HALIDE MATERIAL

(75) Inventors: Colin J. Gray, Wealdstone; Andrew R. Benoy, Watford; Eric Ordia, South Harrow, all of (GB)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/332,843

(22) Filed: Jun. 14, 1999

(30) Foreign Application Priority Data

Jul. 1, 1998 (GB) ..... 9814304

(51) Int. Cl.[7] ..... G03C 5/29
(52) U.S. Cl. ..... 430/440; 430/446
(58) Field of Search ..... 430/440, 446

(56) References Cited

U.S. PATENT DOCUMENTS

| | | | | |
|---|---|---|---|---|
| 5,236,816 A | | 8/1993 | Purol et al. | 430/492 |
| 5,474,879 A | | 12/1995 | Fitterman et al. | 430/487 |
| 5,723,267 A | | 3/1998 | Ito | 430/399 |
| 5,962,202 A | * | 10/1999 | Sampei | 430/440 |

FOREIGN PATENT DOCUMENTS

| | | |
|---|---|---|
| EP | 0 694 808 | 1/1996 |
| EP | 0 758 761 A1 | 2/1997 |

* cited by examiner

*Primary Examiner*—Hoa Van Le

(57) ABSTRACT

A method of forming a photographic image in an imagewise exposed high contrast photographic material free from nucleating agents comprising a support bearing a silver halide emulsion layer comprising silver halide grains wherein at least 10% of the silver halide grains are spectrally sensitized and a hydrophilic colloid having a silver:hydrophilic colloid ratio above 1. The method comprises developing the material in a developer comprising an ascorbic acid developing agent at a pH no greater than 10.5, the developer being free of hydroquinone.

20 Claims, 8 Drawing Sheets

METHOD OF PROCESSING A PHOTOGRAPHIC HIGH CONTRAST SILVER HALIDE MATERIAL

FIELD OF THE INVENTION

The invention relates to a method for processing high contrast silver halide photographic materials.

BACKGROUND OF THE INVENTION

The vast majority of commercially available developers for black and white films are based on hydroquinone. However, the use of hydroquinone is suspect from an ecological point of view. It can have allergic effects and some countries are proposing to list hydroquinone as a suspect carcinogen. Developing agents not showing these disadvantages are ascorbic acid and related compounds [see, for example, P. Meeuws et al., (Agfa Gevaert), *Research Disclosure,* March 1995, p. 185].

Ascorbic acid has been recognized as a developing agent for some time, and, although less active than hydroquinone or catechol, the photographic literature reports it will develop a conventional emulsion at high pH [see, for example, W. E. Lee and E. R. Brown in The Theory of the Photographic Process, 4th ed., ed. T. H. James, Macmillan, New York and London, 1977, chapter 11]. However, the number of instances of the commercialization or useful employment of an ascorbic acid-based developer are relatively few. An ascorbic acid-based developer suitable for hydrazine containing high contrast films has been described in U.S. Pat. No. 5,236,816. Also, U.S. No. 5,474,879 describes an ascorbic acid developer particularly suitable for radiographic films.

For many years the very high contrast photographic images needed in the graphic arts and printing industries were obtained by developing a "lith" emulsion (usually high in silver chloride content) in a hydroquinone, low sulfite, "lith" developer by a process known as infectious development. High contrasts were achieved. However, such low sulfite developers are inherently unstable and are particularly inappropriate for machine processing.

Machine processing of graphics materials was achieved by the use of so-called "rapid access" high contrast materials which have a lower scale (or toe) contrast below 3 and typically about 2, good process latitude and good process stability. Such materials are easy to use but this is at the expense of noticeably reduced dot quality (i.e. a so-called "soft" dot) and hence are not suitable for users requiring the highest of dot qualities. Rapid access film materials are, however, widely accepted and used and are in daily use alongside nucleated products described immediately below.

To achieve the high image quality obtainable from lith processing but with a stable process, emulsions containing nucleating agents, for example hydrazides, have been used and processed in a high pH (~11.5) developer with conventional amounts of sulfite, hydroquinone and co-developer. A further refinement in the area of high contrast materials was the introduction of a lower pH process (typically ~10.4) using hydrazides active at this pH together with the use of an incorporated contrast booster compound, such as an amine. Both these processes provide half-tones with a so-called "hard" dot.

However, such materials incorporating nucleators and booster compounds are not ideally desirable because the process sensitivity is still substantially worse than that obtained with the rapid access process.

The infectious process phenomenon of "co-development" [R. Beels and F. H. Claes, *The Journal of Photographic Science,* 1975, 22, 23] is defined as the tendency for unexposed silver halide grains with no latent image to develop if they are in the near vicinity of developing grains which are fogged. No spectral sensitization is described. The extent of the co-development reported has been insufficient to make this little more than an interesting observation.

EP-A-0 758 761 discloses that when an imagewise exposed silver halide layer having both spectrally sensitized and non-spectrally sensitized silver halide grains, a high silver:gel ratio, and containing an appropriate amine, its density can be enhanced by the co-development effect to give a substantial density gain enabling the production of a high contrast photographic material which does not contain a nucleating agent. Advantages of the enhanced co-development film were cited to be: the lack of a nucleating agent and the use of less silver, gelatin and sensitizing dye to obtain improved contrast/image quality, lower post-process dye stain through reduced dye laydown and reduced cost. In addition the absence of nucleating agents meant the film was free of so-called "pepper fog".

Although efficacious, the use of enhanced co-development films has some limitations and drawbacks. In spite of the fact that such materials are relatively process insensitive in hydroquinone-based developers, there remains some process sensitivity which it would be advantageous to reduce or eliminate.

Additionally, in hydroquinone-based developers where, through poor process management, the pH has been allowed to fall below 10.0 and towards 9.5, the dot quality becomes less acceptable, with ragged high contrast edges which do not give good results on contacting to, for example, a contact film or printing plate.

Finally, at pH values of 10.0 or lower there appears in non-image areas a development of silver specks which are considered to be undesirable.

SUMMARY OF THE INVENTION

A method of forming a photographic image in an imagewise exposed high contrast photographic material free from nucleating agents comprising a support bearing a silver halide emulsion layer comprising silver halide grains wherein at least 10% of the silver halide grains are spectrally sensitized and a hydrophilic colloid having a silver:hydrophilic colloid ratio above 1, the method comprising developing the photographic material in a developer comprising a primary ascorbic acid developing agent at a pH no greater than 10.5, the developer being free of hydroquinone.

The combination of the co-development photographic material and an ascorbic acid-based developer allows for all the previous advantages of the material to be retained, such as a reduction in the amount of sensitizing dye used compared to conventional graphics films thus providing low post-process dye stain and lower product cost, while extending to it the ability to obtain a high contrast result with an ecologically advantageous developer. Unexpectedly, the combination allows process insensitivity greater than that obtained with conventional hydroquinone-based developers. In addition the dot quality from the enhanced co-development photographic material in the ascorbic acid-based developer does not deteriorate as the pH falls. Finally, the unwanted development of silver specks in unexposed areas of the photographic material is significantly and surprisingly reduced by the method of the invention compared against the method in which the same material is developed in a hydroquinone-based developer.

DETAILED DESCRIPTION OF THE INVENTION

Figure 1:
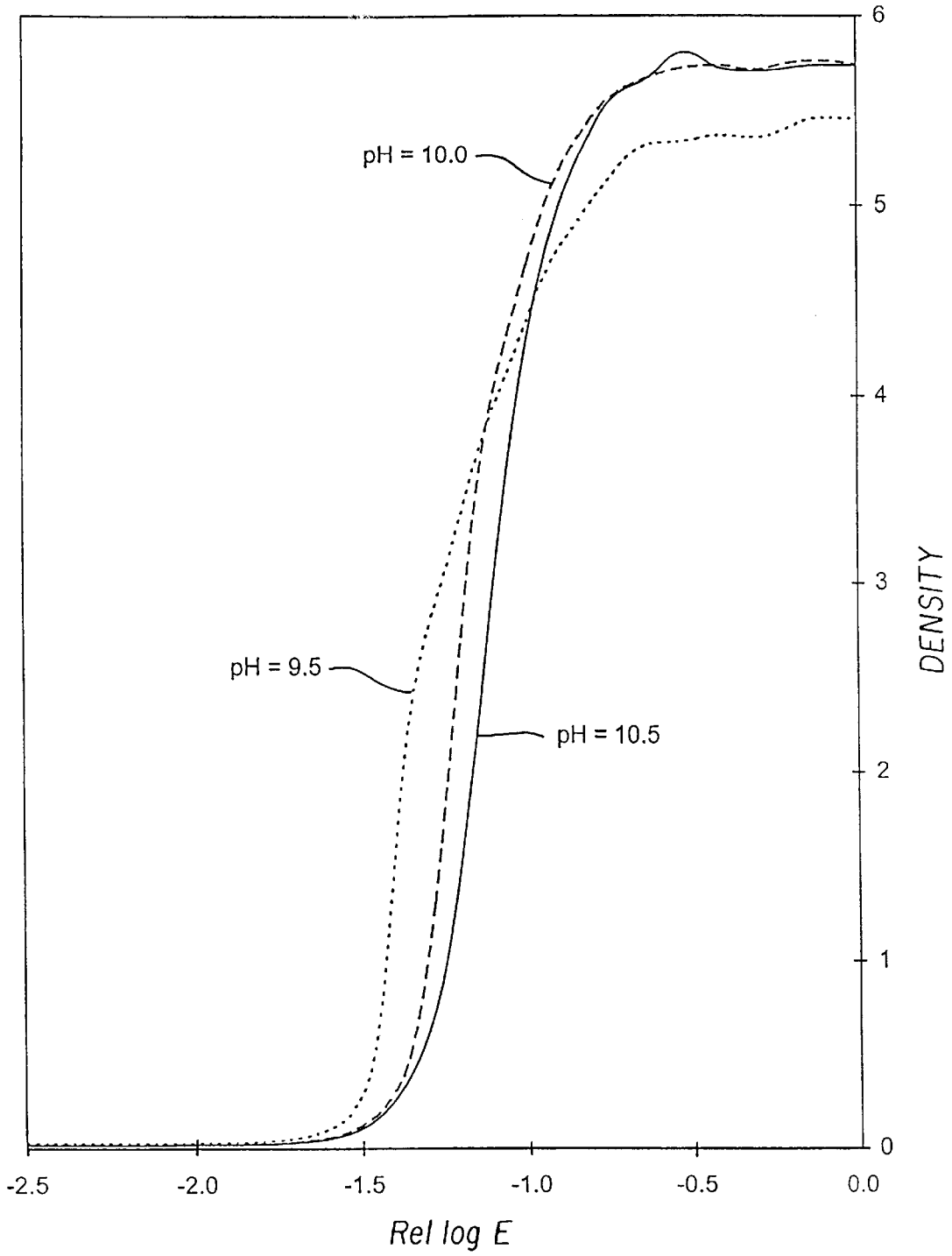
FIGS. 1 to 6 are D-LogE curves showing the sensitometric results obtained from processing photographic materials according to Example 1 below.

An ascorbic acid developing agent includes ascorbic acid and the analogues, isomers and derivatives thereof which function as photographic developing agents. Ascorbic acid developing agents are known in the photographic art and include the following compounds: L-ascorbic acid, D-ascorbic acid, L-erythroascorbic acid, D-glucoascorbic acid, 6-desoxy-L-ascorbic acid, L-rhamnoascorbic acid, D-glucoheptoascorbic acid, imino-L-erythroascorbic acid, imino-D-glucoascorbic acid, imino-6-desoxy-L-ascorbic acid, imino-D-glucoheptoascorbic acid, sodium isoascorbate, L-glycoascorbic acid, D-galactoascorbic acid, L-araboascorbic acid, sorboascorbic acid and sodium ascorbate.

L-ascorbic acid and sodium isoascorbate are preferred developing agents.

The developing composition can also include one or more auxiliary super-additive developing agents as are known in the art (Mason, *Photographic Processing Chemistry,* Focal Press, London, 1975), that is to provide a synergistic effect whereby the combined affect of a mixture of two developing agents is greater than the sum of the individual activities. The aminophenols and 3-pyrazolidones are preferred as such components with the last type of compound being more preferred.

Particularly preferred auxiliary developing agents are disclosed in U.S. Pat. No. 5,457,011 including 1-phenyl-3-pyrazolidone, 1-phenyl-4,4-dimethyl-3-pyrazolidone, 1-phenyl-4-methyl-4-hydroxymethyl-3-pyrazolidone and 1-phenyl-4,4-dihydroxymethyl-3-pyrazolidone. Other useful 3-pyrazolidone developing agents include 1-phenyl-5-methyl-3-pyrazolidone, 1-phenyl-4,4-diethyl-3-pyrazolidone, 1-p-aminophenyl-4-methyl-4-propyl-3-pyrazolidone, 1-p-chlorophenyl-4-methyl-4-ethyl-3-pyrazolidone, 1-p-acetamidophenyl-4,4-diethyl-3-pyrazolidone, 1-p-betahydroxyethylphenyl-4,4 dimethyl-3-pyrazolidone, 1-p-hydroxyphenyl-4,4-dimethyl-3-pyrazolidone, 1-p-methoxyphenyl-4,4-diethyl-3-pyrazolidone and 1-p-tolyl-4,4-dimethyl-3-pyrazolidone.

Useful aminophenols include p-aminophenol, o-aminophenol, N-methylaminophenol, 2,4-diaminophenol hydrochloride, N-(4-hydroxyphenyl)glycine, p-benzylaminophenol hydrochloride, 2,4-diamino-6-methylphenol, 2,4-diaminoresorcinol and N-(β-hydroxyethyl)-p-aminophenol.

More than one primary developing agent can be used in the developing compositions used in this invention. For example, the developing composition can contain two different ascorbic acid developing agents. More than one auxiliary super-additive developing agent can be included in the developing compositions. For example, the developing compositions can contain two different aminophenol developing agents or two different 3-pyrazolidone developing agents or both an aminophenol developing agent and a 3-pyrazolidone developing agent.

It is preferred that the method of the invention comprises developing the material in a developer based on ascorbic acid which is free of any dihydroxybenzene developing agent.

The primary developing agent is present in the working strength developing composition in a conventional amount, that is a least 0.05 mol/l, and preferably at least 0.1 mol/l. The upper limit is generally 1 mol/l, and preferably 0.5 mol/l. The auxiliary super-additive developing agent is generally present in the working strength solution of developing composition in an amount of at least 0.001 mol/l, and preferably at least 0.002 mol/l. The upper limit of such compounds is 0.1 mol/l, and preferably 0.01 mol/l.

It is preferred that the processing composition includes one or more sulfite preservatives. By "sulfite preservative" is meant any sulfur compound that is capable of forming sulfite ions in aqueous alkaline solution. Examples of such compounds include alkali metal sulfites, alkali metal bisulfites, alkali metal metabisulfites, sulfurous acid and carbonyl-bisulfite adducts. Examples of preferred sulfites include sodium sulfite, potassium sulfite, lithium sulfite, sodium bisulfite, potassium bisulfite, lithium bisulfite, sodium metabisulfite, potassium metabisulfite and lithium metabisulfite. The carboyl-bisulfite adducts that are useful as sulfite preservatives are described, for example, in U.S. Pat. No. 5,457,011.

The amount of sulfite preservative used in the working strength processing compositions can vary widely, but generally it is present in an amount of at least 0.05 mol/l, and preferably at least 0.1 mol/l. The upper limit is generally 1.0 mol/l, and preferably 0.5 mol/l.

The processing compositions, when used in working strength, generally have a pH of from about 9.0 to about 10.5, and preferably from about 9.5 to about 10.0. Suitable buffers, such as carbonates, borates and phosphates can be used to provide or maintain the desired pH.

The processing compositions can also include one or more optional components that are commonly used in black-and-white developing compositions, such as metal ion sequestering agents, biocides (including fungicides), antifoggants, antioxidants, stabilizing agents and contrast promoting agents. Such materials are known in the art, for example U.S. Pat. Nos. 5,264,323, 5,298,362 and 5,457,011. Useful stabilizing agents are α-ketocarboxylic acids as described for example in U.S. Pat. No. 4,756,997. Useful biocides include isothiazolines such as 1,2-benzisothazolin-3-one, 2-methyl-4-isothiazolin-3-one, 2-octyl-4-isothiazolin-3-one and 5-chloro-N-methyl-4-isothiazolin-3-one.

The developer solution may also contain a component to reduce or eliminate silver sludge.

Preferably from 50 to 100% of the silver halide grains are spectrally sensitized. In a particular embodiment of the invention, 100% of the silver halide grains are spectrally sensitized.

The preferred range of silver:hydrophilic colloid ratio is 1–5, more preferably 1.5–3.5 and especially 2–3.

Preferably, the method of the invention is carried out in the presence of a density enhancing amine compound. The density enhancing amine compound may be present in the photographic material e.g. in the emulsion layer or an adjacent hydrophilic colloid layer. Alternatively, the density enhancing amine compound may be present in the developer.

The amine density enhancing compounds are amines which when incorporated into a silver halide material containing both spectrally sensitized and non-spectrally sensitized silver halide grains cause a higher density to be obtained under the conditions of development intended for the product.

In one embodiment of the invention the amine density enhancer is an amine which comprises at least one secondary or tertiary amino group, and has an n-octanol/water partition coefficient (log P) of at least one, preferably at least three, and most preferably at least four, log P being defined by the formula:

$$\log P = \log \frac{[X_{octanol}]}{[X_{water}]}$$

wherein X is the concentration of the amino compound.

Preferably such an amine contains within its structure a group comprised of at least three repeating ethyleneoxy units. Examples of such compounds are described in U.S. Pat. No. 4,975,354.

It is preferred that the ethyleneoxy units are directly attached to the nitrogen atom of a tertiary amino group.

Included within the scope of the amino compounds which may be utilized in this invention are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amines are compounds having at least 20 carbon atoms.

In one embodiment the density enhancing amine has the general formula:

$$Y((X)_n—A—B)_m$$

wherein

Y is a group which adsorbs to silver halide,

X is a bivalent linking group composed of hydrogen, carbon, nitrogen and sulfur atoms, B is an amino group which may be substituted, an ammonium group of a nitrogen-containing heterocyclic group, m is 1, 2 or 3 and n is 0 or 1, or the general formula:

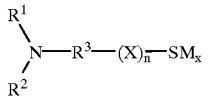

wherein $R^1$ and $R^2$ are each hydrogen or an aliphatic group, or $R^1$ and $R^2$ may together a ring, $R^3$ is a bivalent aliphatic group, X is a bivalent heterocyclic ring having at least one nitrogen, oxygen or sulfur atom as heteroatom, n is 0 or 1, and M is hydrogen or an alkali metal atom, alkaline earth metal atom, a quaternary ammonium, quaternary phosphonium atom or an amidino group, x is 1 when M is a divalent atom; said compound optionally being in the form of an addition salt.

Preferred amino compounds for the purposes of this invention are bis-tertiary-amines which have a partition coefficient of at least three and a structure represented by the formula:

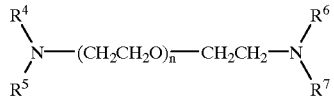

wherein n is an integer with a value of 3 to 50, and more preferably 10 to 50, $R^4$, $R^5$, $R^6$ and $R^7$ are, independently, alkyl groups of 1 to 8 carbon atoms, $R^4$ and $R^5$ taken together represent the atoms necessary to complete a heterocyclic ring, and $R^6$ and $R^7$ taken together represent the atoms necessary to complete a heterocyclic ring.

Another preferred group of amino compounds are bis-secondary amines which have a partition coefficient of at least three and a structure represented by the formula:

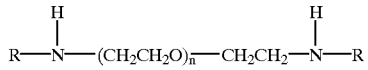

wherein n is an integer with a value of 3 to 50, and more preferably 10 to 50, and each R is, independently, a linear or branched, substituted or unsubstituted, alkyl group of at least 4 carbon atoms.

Particular amines suitable as density enhancers are listed in European Specification 0,364,166.

When the amine density enhancer is incorporated into the photographic material, it may be used in amounts of from 1 to 1000 mg/m$^2$, preferably from 10 to 500 mg/m$^2$ and, especially, from 20 to 200 mg/m$^2$.

It is possible to locate the amine density enhancer in the developer rather than in the photographic material.

The spectrally sensitized silver halide grains can be bromoiodide, chlorobromoiodide, bromide, chlorobromide, chloroiodide or chloride.

The non-spectrally sensitized silver halide grains can be bromoiodide, chloroiodide, chlorobromoiodide, bromide, chlorobromide, or chloride.

Both types of grain may also contain dopants as more fully described below.

Preferably both the spectrally sensitized and the non-spectrally sensitized grains comprise at least 50 mole percent chloride, preferably from 50 to 90 mole percent chloride.

The size of the latent image-forming and non-latent image-forming grains preferably ranges independently between 0.05 and 1.0 $\mu$m in equivalent circle diameter, preferably 0.05 to 0.5 $\mu$m and most preferably 0.05 to 0.35 $\mu$m. The grain populations in the emulsion layer may have the same or differing grain sizes or morphologies.

In one embodiment of the present invention the grain size of the non-spectrally sensitized grains is smaller than that of the spectrally sensitized grains because, due to the covering power of small grains, the required density may be obtained with less silver halide.

As is known in the graphic arts field the silver halide grains may be doped with Rhodium, Ruthenium, Iridium or other Group VIII metals either alone or in combination. The grains may be mono- or poly-disperse. Preferably the silver halide grains are doped with one or more Group VIII metal at levels in the range $10^{-9}$ to $10^{-3}$, preferably $10^{-6}$ to $10^{-3}$, mole metal per mole of silver. The preferred Group VIII metals are Rhodium and/or Iridium.

In addition to graphic arts products the present materials may be black-and-white non-graphic arts photographic materials needing moderate contrasts, for example, microfilm and X-ray products.

The method of this invention can be used to process any suitable black-and-white or color reversal photographic silver halide element. To process color reversal films and papers, the black-and-white developing composition is generally used in the first development step prior to treatment with a reversal bath and a color developing solution. Such photographic elements and processes are well known in the art as described, for example, in U.S. Pat. No. 5,523,195.

Preferably, the method of this invention are useful to provide black-and-white images in black-and-white films or papers, including radiographic films aerial films, industrial films and graphic arts films as well as amateur and professional black-and-white films and papers.

The emulsions employed and the addenda added thereto, the binders, supports, etc. may be as described in Research Disclosure Item 308119, December 1989 published by Kenneth Mason Publications, Emsworth, Hants, United Kingdom.

The hydrophilic colloid may be gelatin or a gelatin derivative, polyvinylpyrrolidone or casein and may contain a polymer. Suitable hydrophilic colloids and vinyl polymers and copolymers are described in Section IX of Research Disclosure Item 308119, December 1989 published by Kenneth Mason Publications, Emsworth, Hants, United Kingdom. Gelatin is the preferred hydrophilic colloid.

The present photographic materials may also contain a supercoat hydrophilic colloid layer which may also contain a vinyl polymer or copolymer located as the last layer of the coating (furthest from the support). It may contain some form of matting agent. The vinyl polymer or copolymer is preferably an acrylic polymer and preferably contains units derived from one or more alkyl or substituted alkyl acrylates or methacrylates, alkyl or substituted alkyl acrylamides or acrylates or acrylamides containing a sulfonic acid group.

The present emulsion layer is preferably formed by sensitizing an emulsion with a dye and then, if required, combining the spectrally sensitized emulsion with a non-spectrally sensitized emulsion. Preferably the sensitizing dye is chosen so that it does not become desorbed from said spectrally sensitized grains.

Two emulsion components can be used where the first component is a "causer" emulsion which is a normal i.e. chemically and spectrally sensitized component coated in the range 10 to 100%, preferably 50 to 100% by weight of the total silver laydown. The requirements for the second "receiver" emulsion component are that it be clean, i.e. free of fog, and be capable of being developed by the enhanced co-development process.

The lower dye laydown which is possible using this invention is also particularly advantageous for systems which have been designed to run under low replenishment rate. Under normal replenishment rates (typically 300–600 $ml/m^2$) there is sufficient overflow of solution to carry out the build up of dye products released into the solution. If these dye products are not bleached by the chemistry then under low replenishment (300 $ml/m^2$ and below) the residual dye builds up to unacceptable levels causing dye stain on the materials being processed. This problem can be effectively eliminated or reduced by removing the need for the usual amounts of dye.

Where a particular spectral sensitization requires the use of compounds not necessary in the other emulsion components of the coating, the laydown of these compounds may be reduced. This reduction will lead to cost savings. These compounds may further have undesirable properties, such as high post-process UV Dmin, and their effect can be reduced.

As the speed of the non-spectrally sensitized emulsion is not critical to the final photographic speed of the coated product this emulsion does not require chemical sensitization and thus the production of this component requires fewer steps in the manufacturing process and less stringent quality control leading to manufacturability and cost benefits.

As the maximum density of the material is not primarily dependant upon latent image-forming grains, the invention has the advantage that imaging emulsions of grain size above those used in standard high contrast coatings can be used without the need to increase the overall silver laydown. The sensitizing dye may have one of the general formulae:

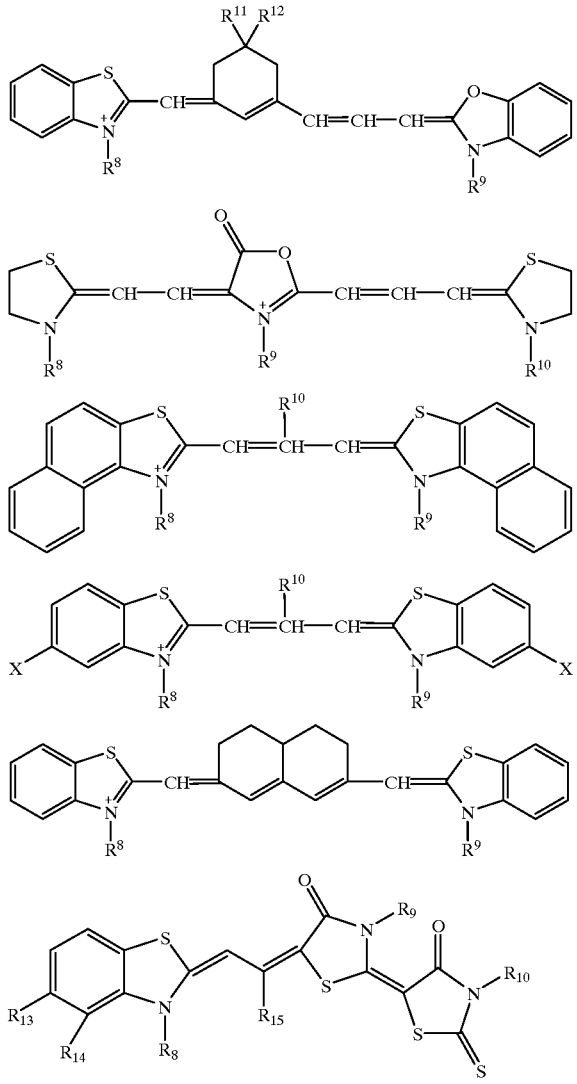

wherein $R^8$, $R^9$ and $R^{10}$ represent an alkyl group which may be substituted, for example with an acid water-solubilizing group, for example a carboxy or sulfo group, $R^{11}$ and $R^{12}$ are an alkyl group of 1–4 carbon atoms, $R^{13}$, $R^{14}$ and $R^{15}$ represent H, substituted or unsubstituted alkyl or substituted or unsubstituted aryl, and X is a halogen, for example chloro, bromo, iodo or fluoro.

The present photographic materials preferably contain an antihalation layer on either side of the support. Preferably it is located on the opposite side of the support from the emulsion layer. In a preferred embodiment an antihalation dye is contained in the hydrophilic colloid underlayer. The dye may also be dissolved or dispersed in the underlayer. Suitable dyes are listed in the Research Disclosure mentioned above.

The light-sensitive silver halide contained in the photographic elements can be processed following exposure to form a visible image by associating the silver halide with an aqueous alkaline medium in the presence of the ascorbic acid developing agent contained in the medium or the element.

The present photographic materials are particularly suitable for exposure by red or infra-red laser diodes, light emitting diodes or gas lasers, e.g. a Helium/Neon or Argon laser.

The invention is further described by way of example in the Examples given below.

EXAMPLE 1

A polyethylene terephthalate film support (with an antihalation pelloid layer) was coated with an emulsion layer consisting of a spectrally sensitized emulsion and a non-spectrally sensitized emulsion, an interlayer, and a protective supercoat. The supercoat was a standard formula containing matte beads and surfactants and was coated at a gel laydown of 0.49 g/m$^2$. The interlayer contained the amine density enhancer compound of the formula:

$$(C_3H_7)_2N(CH_2CH_2O)_{14}CH_2CH_2N(C_3H_7)_2$$

and a latex copolymer and was coated at a gel level of 1.0 g/m$^2$.

The emulsion substrates used for the dyed and undyed components were not the same. The dyed component consisted of a 70:30 chlorobromide cubic monodispersed emulsion (0.21 $\mu$m edge length), whereas the undyed component consisted of a 70:30 chlorobromide cubic monodispersed emulsion (0.18 $\mu$m edge length). Their silver laydowns were 1.98 and 1.32 g Ag/m$^2$, respectively, giving a total silver laydown of 3.30 g Ag/m$^2$. Both were suitably chemically sensitized with a 10 minute digestion at 65° C. The dyed emulsion contained a sensitizing dye giving a broad response between 630 and 670 mn, potassium iodide and a suitable anti-foggant package. The undyed emulsion contained no dye, potassium iodide and a suitable anti-foggant package. The total gel laydown of the emulsion layer was 1.21 g/m$^2$, and the silver:gelatin ratio was 2.73.

In order to aid the coating of this relatively low gelatin coating a conventional thickening agent was added to increase melt viscosity and to give acceptable coating quality. The dyed emulsion melt was kept separate from the undyed emulsion melt until they were mixed in line immediately before the coating hopper.

The above coating was evaluated by exposing through a 0.1 increment step wedge with a $10^{-6}$ flash sensitometer fitted with a red light WRATTEN™ 29 filter and then processed in KODAK™ RA2000 Developer (diluted 1+2), which had been adjusted to a pH of 10.5, at 35° C. for 30 seconds. After development, the coating was fixed, washed and dried. The commercially available rapid access film KODAK™ PAGI-SET HN film was exposed and processed likewise, as was the commercially available nucleated film KODAK™ RECORDING 2000 HN film. The exposing and processing steps of all three films were repeated in the same developer after adjustment of the pH to 10.0 and to 9.5.

The same three films were exposed in a like manner and then processed at 35° C. for 30 seconds in an ascorbic acid-based developer with the following formula:

TABLE 1

| Component | Amount for 1 liter |
|---|---|
| Water | 600.0 g |
| Potassium sulfite solution (45% w/w) | 44.0 g |
| Potassium hydroxide solution (45.5% w/w) | 5.0 g |
| Dimezone-S | 2.0 g |
| L-Ascorbic acid | 35.0 g |
| Sodium bromide | 3.8 g |
| VERSANEX ™ 80 | 10.0 g |
| IRGAFORM ™ 3000 | 3.25 g |
| Benzotriazole | 0.20 g |
| Potassium carbonate | 100.0 g |
| pH adjust to | 10.5 |
| Water to | 1 liter |

Figure 2:
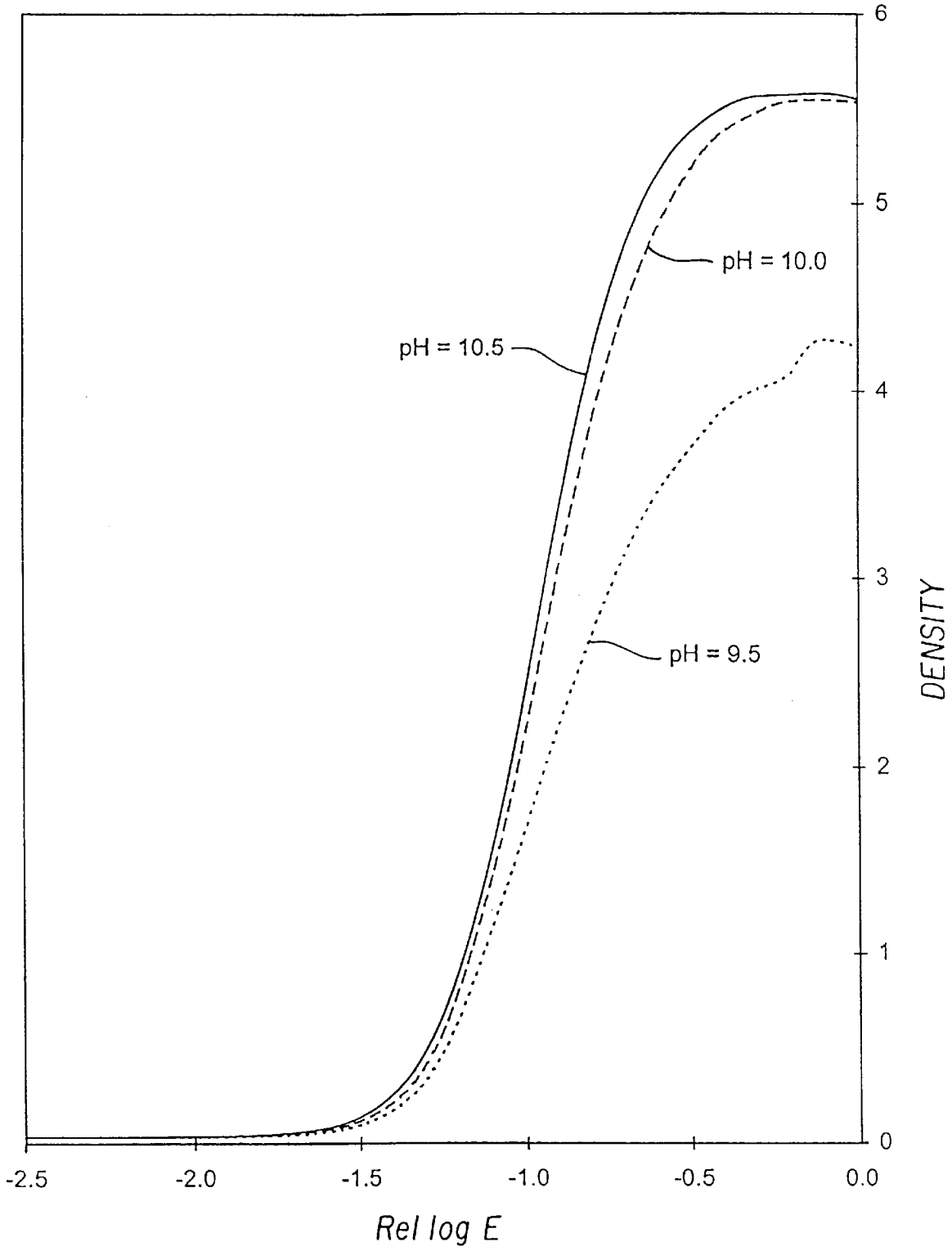
Figure 3:
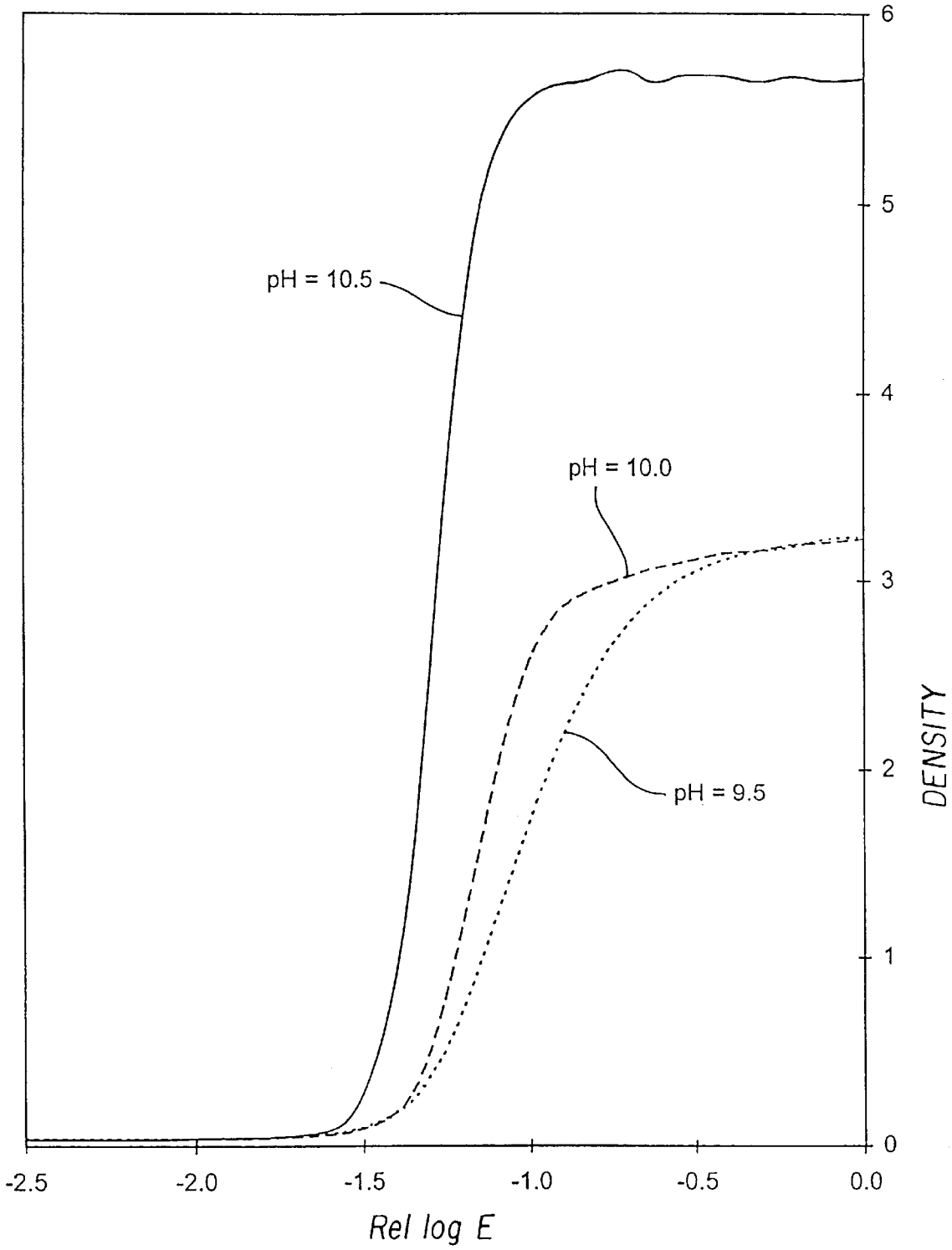
Figure 4:
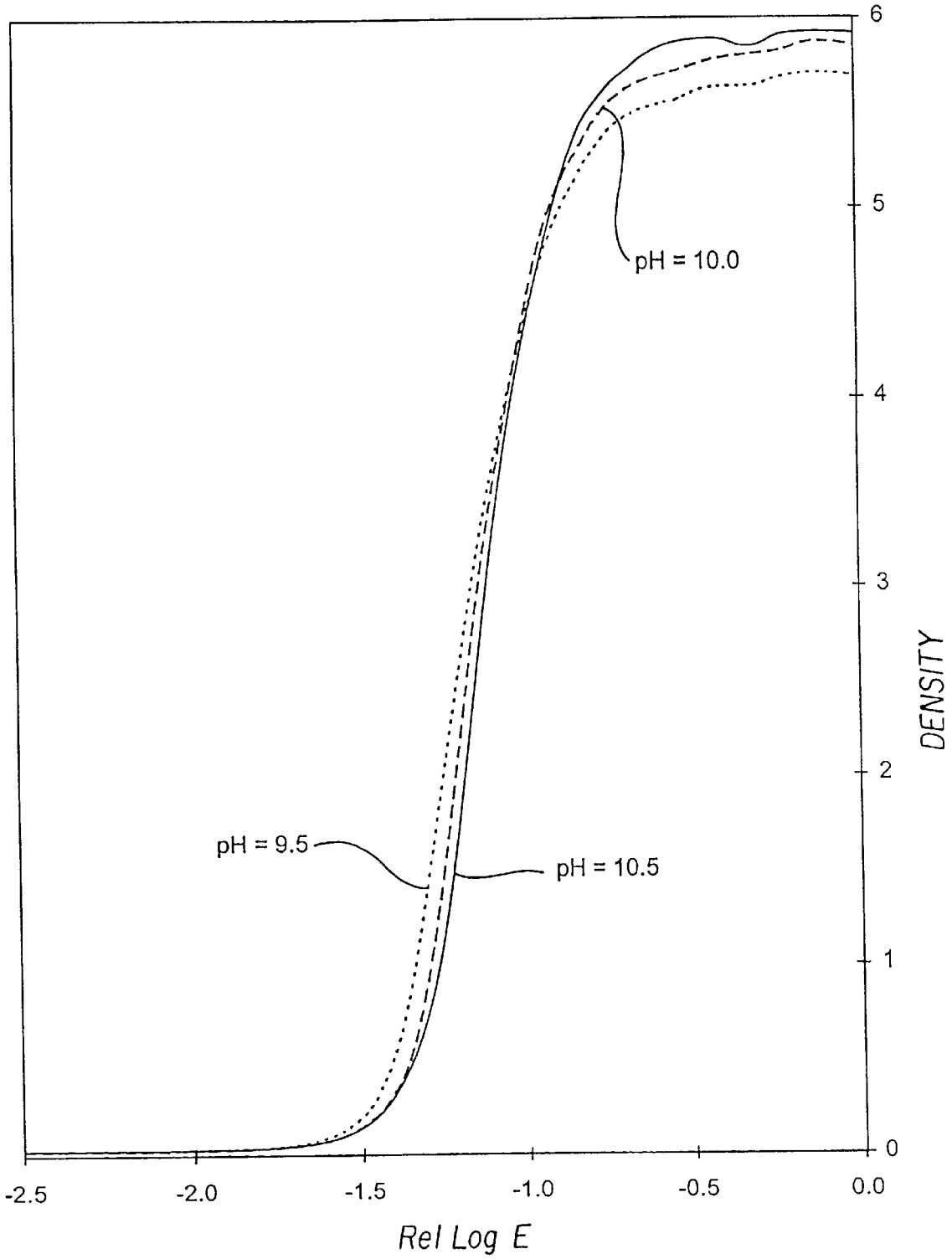
Figure 5:
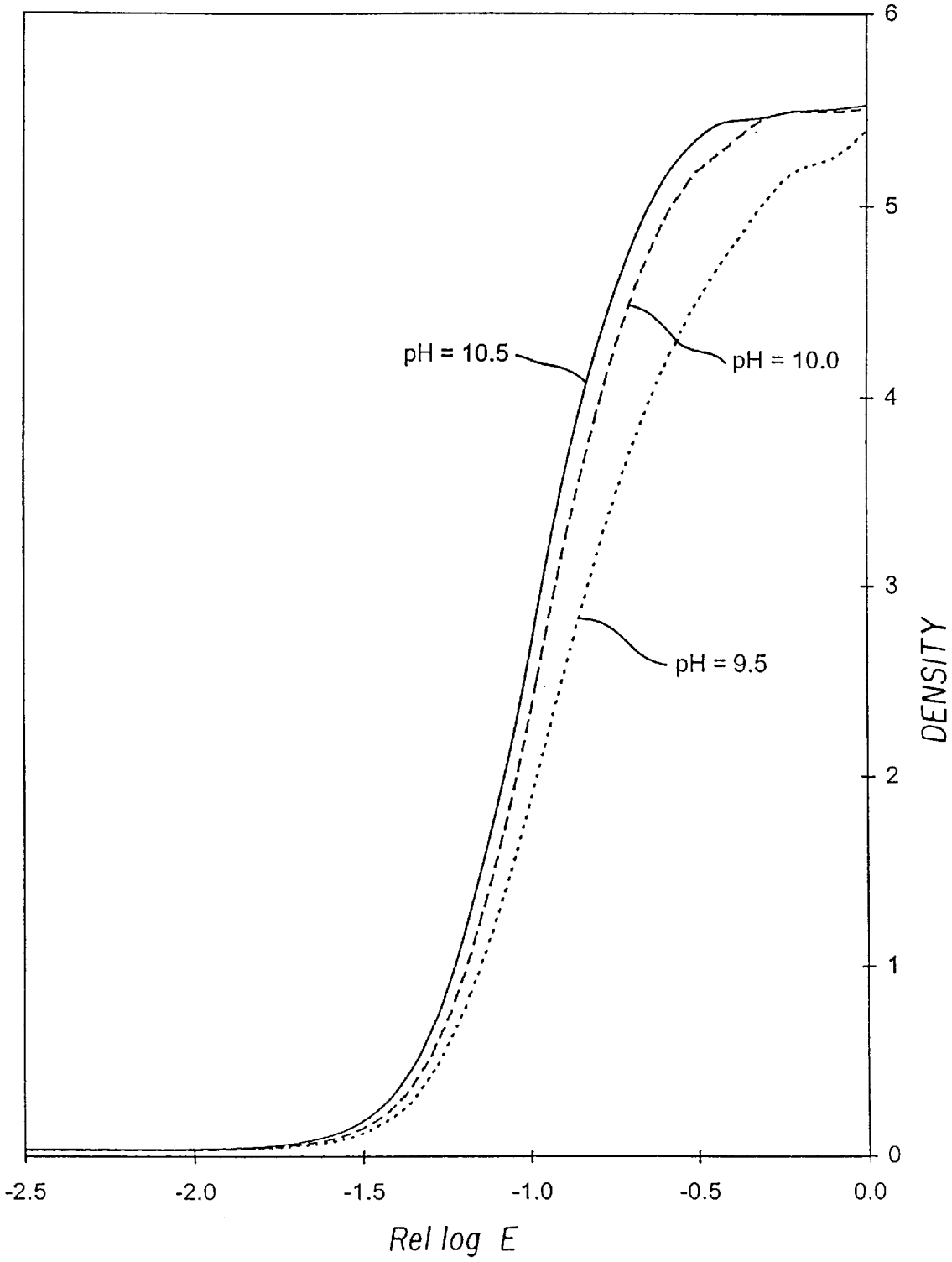
Figure 6:
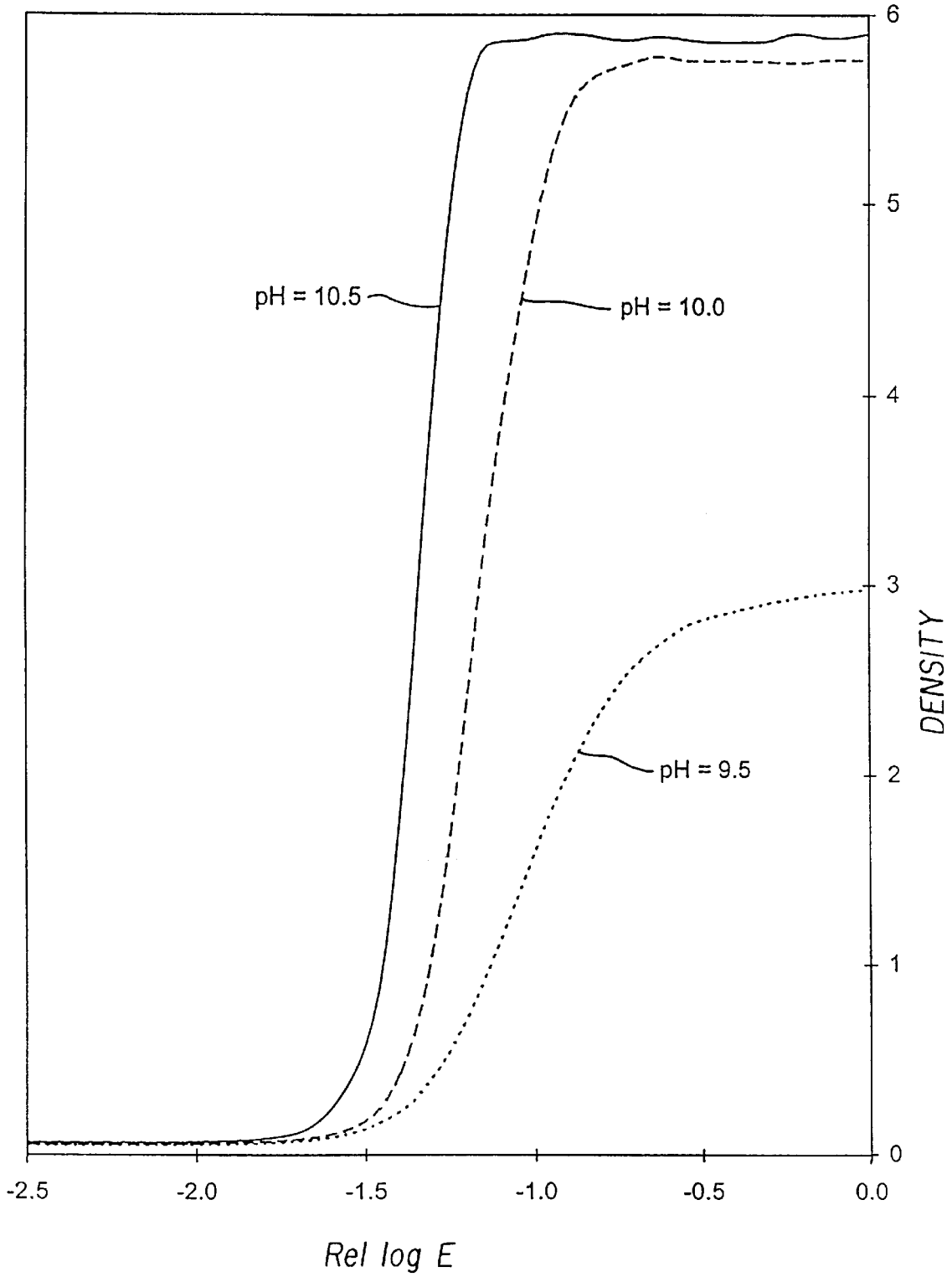

The exposing and processing steps were repeated after the developer had been adjusted to a pH of 10.0, and to a pH of 9.5. The sensitometric results for processing in RA2000 (1+2) are shown in FIGS. 1 to 3 with selected sensitometric parameters shown in Table 2. Likewise, the sensitometric results for processing in the ascorbic acid-based developer are shown in FIGS. 4 to 6 with selected sensitometric parameters in Table 3.

TABLE 2

| Film | pH | Speed (D = 0.6) | Midscale Contrast | D-max |
|---|---|---|---|---|
| Enhanced Co-Development | 10.5 | 1.44 | 6.67 | 5.80 |
| | 10.0 | *+0.04* | *+1.37* | *−0.04* |
| | 9.5 | *+0.21* | *+3.11* | *−0.34* |
| KODAK ™ PAGI-SET HN | 10.5 | 1.40 | 4.62 | 5.57 |
| | 10.0 | *−0.02* | *+0.01* | *−0.04* |
| | 9.5 | *−0.05* | *−0.69* | *−1.29* |
| KODAK ™ RECORDING 2000 HN | 10.5 | 1.57 | 9.35 | 5.69 |
| | 10.0 | *−0.16* | *−3.76* | *−2.46* |
| | 9.5 | *−0.21* | *−5.66* | *−2.46* |

TABLE 3

| Film | pH | Speed (D = 0.6) | Midscale Contrast | D-max |
|---|---|---|---|---|
| Enhanced Co-Development | 10.5 | 1.46 | 6.44 | 5.92 |
| | 10.0 | *+0.01* | *+0.33* | *−0.05* |
| | 9.5 | *+0.06* | *+0.31* | *−0.22* |
| KODAK ™ PAGI-SET HN | 10.5 | 1.44 | 4.40 | 5.53 |
| | 10.0 | *−0.04* | *−0.01* | *−0.02* |
| | 9.5 | *−0.07* | *−0.32* | *−0.13* |
| KODAK ™ RECORDING 2000 HN | 10.5 | 1.62 | 8.42 | 5.90 |
| | 10.0 | *−0.13* | *−1.22* | *−0.13* |
| | 9.5 | *−0.26* | *−5.31* | *−2.92* |

The data in italics in Tables 2 and 3 at pH 10.0 and pH 9.5 indicate the sensitometric change from pH 10.5.

In RA2000 (1+2) (Table 2) it will be noted that both commercially available films show deterioration in sensitometry as the pH is changed to 10.0 and 9.5 from 10.5. The enhanced co-development film shows the best stability, especially in terms of midscale contrast and D-max, but the significant gain in speed (0.21 log E) on going from pH 10.5 to 9.5 is undesirable.

Processing in the ascorbic acid-based developer (Table 3) provides very stable sensitometry over the pH range 10.5 to 9.5 for the enhanced co-development film. This is desirable as it implies that a minimum of processor control is required for the combination of the invention. The nucleated film gave a loss of contrast on going from pH 10.5 to 10.0, and a large loss in D-max from pH 10.0 to 9.5. Although the rapid access film was moderately stable over the pH range, it should be noted from FIG. 5 that the upper scale contrast sagged at pH 9.5. The enhanced co-development film and ascorbic acid-based developer combination showed distinct advantages over the rapid access film, and over the enhanced co-development film and hydroquinone-based developer combination, in terms of contrast, D-max, photographic speed and processing stability.

EXAMPLE 2

Samples of the enhanced co-development film of the invention, KODAK™ PAGI-SET HN film, and KODAK™ RECORDING 2000 HN film were exposed on a Linotronic 330 imagesetter (a helium-neon (HN) exposing device manufactured by LINOTYPE HELL™). The films were exposed to an image containing areas of text, D-max and D-min, as well as half-tone dots of various sizes over the range 1 to 99%. For each film sample the image was repeated a number of times (25) so as to obtain a "sweep" of exposures such that at one end of the galley the film was underexposed while at the other the film was overexposed.

The exposed films were developed in both RA2000 (1+2) and the ascorbic acid-based developer of Example 1 above, at pH 10.5, 10.0 and 9.5, at 35° C. for 30 seconds. Each exposure patch was read for D-max and size of the 50% dot, using an X-RITE™ 361T densitometer. A particular note was made of the imagesetter exposure value on each galley where the 50% dot read as a 55 to 60% dot, providing that the D-max was at least 4.2.

Each film sample was then contacted on to KODAK™ CONTACT 2000 CA4 general purpose contact film using a KODAK™ 2800 contact frame. The contacts were developed in RA2000 (diluted 1+4) at 35° C. for 30 seconds. The dot size corresponding to the galley patches of interest were read and compared to the theoretical dot size that might have been expected, assuming no dot gain. (Half tone dots which are "soft" give a larger dot gain on contacting than dots which are "hard". It is accepted that the best image quality and tone reproduction is provided by "hard" dot films.) The results of this test are summarized in Tables 4 and 5, for the RA2000 (1+2) and ascorbic acid-based developers, respectively.

TABLE 4

| | | | Contacting | | |
|---|---|---|---|---|---|
| Film | pH | Dot Size | Theory | Found | Dot Gain |
| Enhanced Co-Development | 10.5 | 56.0% | 44.0% | 46.6% | 2.6% |
| | 10.0 | 59.2% | 40.8% | 44.1% | 3.3% |
| | 9.5 | 60.4% | 39.6% | 45.4% | 5.8% |
| KODAK ™ PAGI-SET HN | 10.5 | 57.1% | 42.9% | 47.0% | 4.1% |
| | 10.0 | 56.7% | 43.3% | 47.5% | 4.2% |
| | 9.5 | —* | —* | —* | —* |
| KODAK ™ RECORDING 2000 HN | 10.5 | 55.0% | 45.0% | 46.4% | 1.4% |
| | 10.0 | —* | —* | —* | —* |
| | 9.5 | —* | —* | —* | —* |

TABLE 5

| | | | Contacting | | |
|---|---|---|---|---|---|
| Film | pH | Dot Size | Theory | Found | Dot Gain |
| Enhanced Co-Development | 10.5 | 56.4% | 43.6% | 46.5% | 2.9% |
| | 10.0 | 57.5% | 42.5% | 44.8% | 2.3% |
| | 9.5 | 59.9% | 40.1% | 43.0% | 2.9% |
| KODAK ™ PAGI-SET HN | 10.5 | 57.8% | 42.2% | 45.9% | 3.7% |
| | 10.0 | 57.4% | 42.6% | 47.3% | 4.7% |
| | 9.5 | 59.6% | 40.4% | 45.5% | 5.1% |
| KODAK ™ RECORDING 2000 HN | 10.5 | 59.7% | 40.3% | 42.6% | 2.3% |
| | 10.0 | 54.9% | 45.1% | 46.8% | 1.7% |
| | 9.5 | —* | —* | —* | —* |

*A dash in Tables 4 & 5 indicates that no satisfactory practical exposure was obtained.

It will be seen from the data presented in Table 4 for development in a conventional hydroquinone-based developer that, at pH 10.5, dot gains typical of the three film types were given, viz. a "soft" dot for the rapid access material, a "hard" dot for the nucleated material, and an intermediate dot quality ("semi-hard" dot) for the enhanced co-development film of the invention. As the pH of the hydroquinone-based developer is lowered, so it becomes increasingly difficult to obtain a satisfactory result in terms of a mid-tone dot for a density greater than or equal to that required for acceptable contacting (D at least 4.2). At pH 9.5 the enhanced co-developer photographic material is the only one to give a practical result from the imagesetter exposures, although it will be noted that the dot gain has grown to unsatisfactory proportions (5.8%).

In comparison, when the enhanced co-developer film and ascorbic acid-based developer are used in combination, across the whole pH range 10.5 to 9.5, excellent dot quality was achieved. The comparison films behaved less satisfactorily: by a pH of 9.5 the rapid access film had started to give an unacceptable dot gain (5.1%), and the nucleated film had failed to provide acceptable densities. Hence, the combination of film material and developer of the invention provides a route to high quality "semi-hard" dots in conditions demonstrated to be unfavorable for films and developers of the known art.

EXAMPLE 3

The imagesetter-exposed and processed samples of Example 2 were examined by means of a NIKON™ binocular microscope connected to a COHU™ high performance CCD camera. The areas chosen for examination were the 50% written half-tone dots used for the contacting tests. Each patch was viewed and focused using a television monitor, and a digital image captured using an ADVICE™ image analysis system (Brian Reece Scientific Ltd).

Side by side comparisons of the images were then made. The results obtained for the enhanced co-developer film in both the hydroquinone-based and ascorbic acid-based developers at pH 10.0 and at pH 9.5 are reproduced as FIGS. 7 to 10.

Figure 7:
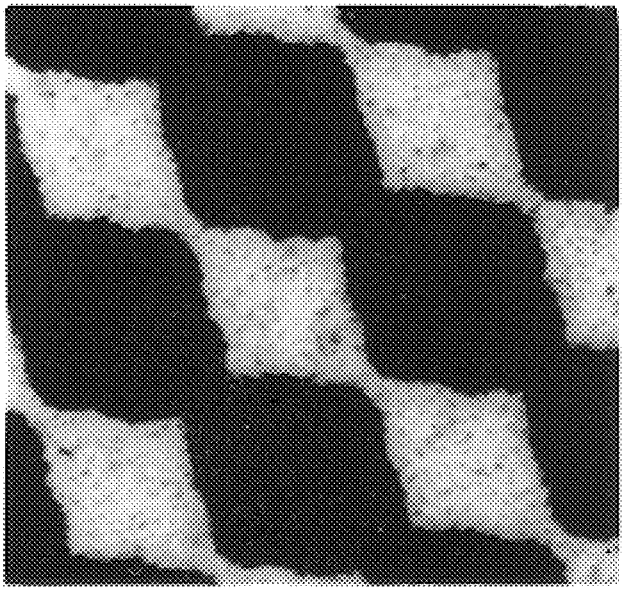
FIGS. 7 to 10 are magnified images of 50% written half-tone dots produced by processing photographic materials according to Example 3 below.
Figure 8:
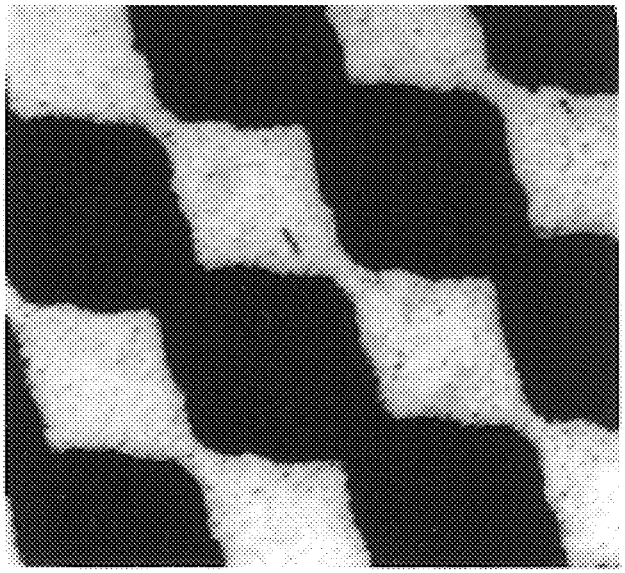
Figure 9:
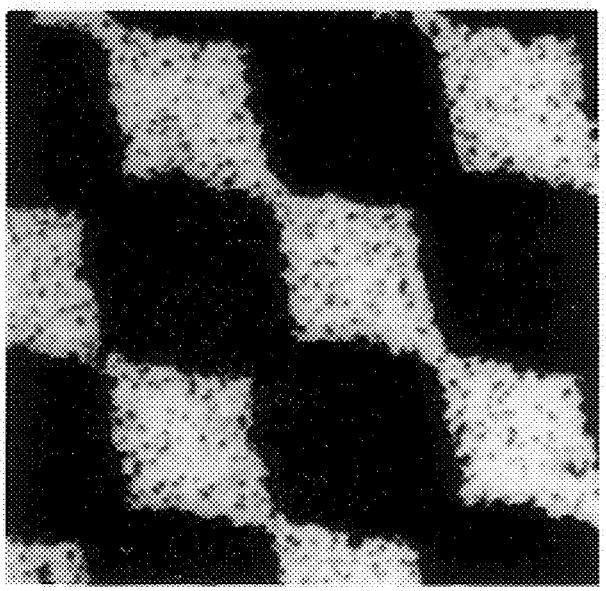

It will be seen from FIG. 7 that a low level of developed background silver speckle is apparent in the unexposed regions of the enhanced co-developer film when a hydroquinone-based developer is employed at a pH of 10.0. The corresponding ascorbic acid-based developer at pH 10.0 shows no sign of developed speckle (FIG. 8).

Figure 10:
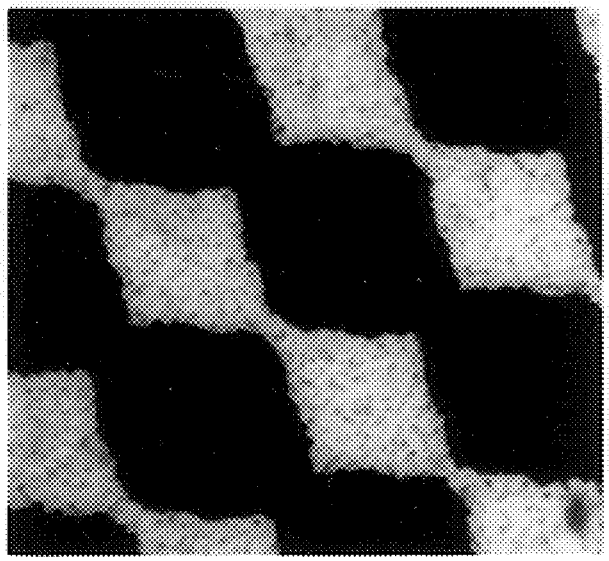

Furthermore, at pH 9.5, an undesirable level of developed speckle is given in RA2000 (1+2) (see FIG. 9), whilst at the same pH hardly any speckle is developed in the ascorbic acid-based developer (FIG. 10).

The invention has been described in detail with particular reference to certain preferred embodiments thereof, but it will be understood that variations and modifications can be effected within the spirit and scope of the invention.

What is claimed is:

1. A method of forming a photographic image in an imagewise exposed high contrast photographic material free from nucleating agents comprising a support bearing a silver halide emulsion layer comprising silver halide grains wherein at least 50% of the silver halide grains are spectrally sensitised and a hydrophilic colloid having a silver:hydrophilic colloid ratio above 1, said method comprising developing said material in a developer comprising a primary ascorbic acid developing agent in an amount from 0.1 to 0.5 mol/l at a pH from 9.5 to 10.5, a 3-pyrazolidone or aminophenol auxiliary developing agent in an amount from 0.001 to 0.1 mol/l, and an alkali metal sulphite in an amount from 0.05 to 0.33 mol/l, said developer being free of hydroquinone, and said material being developed in the presence of a density enhancing amine compound.

2. The method of claim 1 wherein said photographic material is developed at a pH no greater than 10.

3. The method of claim 1 wherein said density enhancing amine compound is present in said silver halide emulsion layer or said adjacent hydrophilic colloid layer.

4. The method of claim 1 wherein said primary developing agent is L-ascorbic acid or sodium isoascorbate.

5. The method of claim 1 wherein from 50 to 100% of said silver halide grains are spectrally sensitized.

6. The method of claim 1 wherein 100% of said silver halide grains are spectrally sensitized.

7. The method of claim 1 wherein said developer further comprises an auxiliary super-additive developing agent.

8. The method of claim 1 wherein said developer further comprises a sulfite preservative.

9. The method of claim 1 wherein the silver:hydrophilic colloid ratio is from 1 to 5.

10. The method of claim 9 wherein the silver:hydrophilic colloid ratio is from 1.5 to 3.5.

11. A method according to claim 1 wherein the density enhancing amine comprises at least one secondary or tertiary amino group and has a log P value of at least one.

12. A method according to claim 1 wherein the density enhancing amine contains within its structure a group comprised of at least three repeating ethyleneoxy units.

13. A method according to claim 1 wherein the density enhancing amine has at least 20 carbon atoms.

14. A method according to claim 1 wherein the density enhancing amine is selected from the group comprising density enhancing amines having the general formula:

$$Y((X)_n—A—B)_m$$

wherein

Y is a group which adsorbs to silver halide,

X is a bivalent linking group composed of hydrogen, carbon, nitrogen and sulphur atoms, B is an amino group that may be substituted, an ammonium group of a nitrogen-containing heterocyclic group, m is 1, 2 or 3 and n is 0 or 1, and density enhancing amines having the general formula:

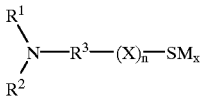

wherein $R^1$ and $R^2$ are each hydrogen or an aliphatic group, or $R^1$ and $R^2$ may together a ring, $R^3$ is a bivalent aliphatic group, X is a bivalent heterocyclic ring having at least one nitrogen, oxygen or sulphur atom as heteroatom, n is 0 or 1, and M is hydrogen or an alkali metal atom, alkaline earth metal atom, a quaternary ammonium, quaternary phosphonium atom or an amidino group, x is 1 when M is a divalent atom;

said compound optionally being in the form of an addition salt.

15. A method according to claim 1 wherein the density enhancing amine is selected from the group comprising density enhancing amines having a log P of at least three and having the general formula:

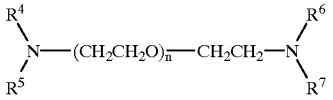

wherein n is an integer with a value of 3 to 50, and more preferably 10 to 50, $R^4$, $R^5$, $R^6$ and $R^7$ are, independently, alkyl groups of 1 to 8 carbon atoms, $R^4$ and $R^5$ taken together represent the atoms necessary to complete a heterocyclic ring, and $R^6$ and $R^7$ taken together represent the atoms necessary to complete a heterocyclic ring, and the general formula:

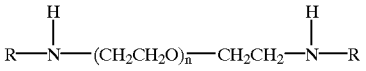

wherein n is an integer with a value of 3 to 50, and more preferably 10 to 50, and each R is, independently, a linear or branched, substituted or unsubstituted, alkyl group of at least 4 carbon atoms.

16. A method according to claim 1 wherein the density enhancing amine is present in the photographic material in amount from 1 to 1000 mg/m$^2$.

17. A method according to claim 1 wherein the density enhancing amine is present in the photographic material in amount from 10 to 500 mg/m$^2$.

18. A method according to claim 1 having a silver:hydrophilic colloid ratio of from 2 to 3.

19. A method according to claim 1 wherein the silver halide emulsion layer comprises spectrally sensitised silver halide grains and non-spectrally sensitised silver halide grains having a size between 0.05 and 0.5 $\mu$m equivalent circle diameter.

20. A method according to claim 19 wherein grain size of the non-spectrally sensitised silver halide grains is smaller than that of the spectrally sensitised silver halide grains.

* * * * *